US008309634B2

(12) United States Patent
Beyer et al.

(10) Patent No.: US 8,309,634 B2
(45) Date of Patent: Nov. 13, 2012

(54) POLYVINYLIDENE CHLORIDE COMPOSITIONS AND THEIR USE IN MONOFILAMENT STRUCTURES

(75) Inventors: Douglas E. Beyer, Midland, MI (US); Valerie Renard, Vendenheim (FR)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 13/059,461

(22) PCT Filed: Aug. 6, 2009

(86) PCT No.: PCT/US2009/052941

§ 371 (c)(1), (2), (4) Date: Feb. 17, 2011

(87) PCT Pub. No.: WO2010/025015

PCT Pub. Date: Mar. 4, 2010

(65) Prior Publication Data

US 2011/0144249 A1 Jun. 16, 2011

Related U.S. Application Data

(60) Provisional application No. 61/190,264, filed on Aug. 27, 2008.

(51) Int. Cl.
*C08K 5/1515* (2006.01)
*B28B 3/20* (2006.01)

(52) U.S. Cl. ..... 524/114; 264/176.1

(58) Field of Classification Search ..... 524/114; 264/176.1

See application file for complete search history.

(56) References Cited

U.S. PATENT DOCUMENTS

| | | | | |
|---|---|---|---|---|
| 2,233,442 | A | 3/1941 | Wiley | |
| 2,905,651 | A | 9/1959 | Reid et al. | |
| 3,642,743 | A | 2/1972 | Schuetz | |
| 3,879,359 | A | 4/1975 | Hinkamp et al. | |
| 6,627,679 | B1 | 9/2003 | Kling | |
| 2003/0170443 | A1 * | 9/2003 | Kobe et al. | 428/317.3 |
| 2006/0122308 | A1 * | 6/2006 | Wermter et al. | 524/445 |
| 2008/0315453 | A1 * | 12/2008 | Molitor et al. | 264/209.1 |

FOREIGN PATENT DOCUMENTS

| | | |
|---|---|---|
| EP | 0402173 | 12/1990 |

OTHER PUBLICATIONS

Kun Sup Hyun, "Melt Rheology of Vinylidene Chloride-Vinyl Chloride Copolymers," Journal of Vinyl Technology, vol. 8, No. 3, p. 103-106 (Sep. 1986).

Rauwendaal, "Extrusion" in Encyclopedia of Polymer Science and Technology, online ed., John Wiley (2002, last updated May 27, 2008, as accessed Jun. 11, 2008) v.2, pp. 497-558.

Wessling, Gibbs, Obi, Beyer, DeLassus and Howell "Vinylidene Chloride Polymers" in Encyclopedia of Polymer Science and Technology, online ed., John Wiley (2002, last updated May 27, 2008, as accessed Jun. 11, 2008) v.4, pp. 458-510.

E.D. Serdynsky, "Polyvinylidene Chloride Fibers" in H. F. Mark, S. M. Atlas and E. Cernia eds., Man Made Fibers, vol. III, Interscience, N.Y. (1968) pp. 303-326.

* cited by examiner

*Primary Examiner* — Kriellion Sanders

(74) *Attorney, Agent, or Firm* — Whyte Hirschboeck Dudek SC

(57) ABSTRACT

The present invention includes a monofilament obtainable by extruding a composition comprising: (a) at least one vinylidene chloride polymer/methyl acrylate interpolymer having at most about 6 weight percent methyl acrylate mer units in the polymer; and (b) at least about three weight percent total plasticizer, of which about 0.5 weight percent based on total composition weight is an epoxy plasticizer or combination thereof through a die such that monofilament is formed. Optionally, and preferably in extruders wherein the composition of (a) and (b) exhibits less uniformity in extrusion than is desired, at least one methacrylic polymer is also added. The invention also includes a process of extruding a composition of at least (a) and (b) to form a monofilament.

20 Claims, No Drawings

POLYVINYLIDENE CHLORIDE COMPOSITIONS AND THEIR USE IN MONOFILAMENT STRUCTURES

CROSS REFERENCE STATEMENT

This application claims benefit of U.S. Provisional Application No. 61/190,264, filed Aug. 27, 2008.

BACKGROUND

Field of the Invention

This invention relates to vinylidene chloride polymer compositions and structures formed from the compositions, particularly monofilament structures.

Compositions comprising vinylidene chloride polymers, both where the vinylidene chloride is polymerized with vinyl chloride and with esters such as methyl, ethyl, propyl and butyl acrylates are well known. Especially the polymers of vinylidene chloride with vinyl chloride have long been used to make fibers including monofilament fibers. See, for instance, E. D. Serdynsky, "Polyvinylidene Chloride Fibers" in H. F. Mark, S. M. Atlas and E. Cernia eds., Man Made Fibers, Vol. III, Interscience, N.Y. (1968) pages 303-326. Among the ester copolymers of vinylidene chloride, the ethyl acrylate copolymer with vinylidene chloride has been used for fibers. However, problems of processability have made the use of copolymers of methyl acrylate and vinylidene chloride difficult to use in fibers because of slow crystallization or poor extrusion processing. Poor extrusion processing can be evidenced by excessive polymer degradation resulting in discoloration, gas bubbles and carbon formation. Poor extrusion processing can also be a result of poor feeding of the polymer in the extruder. This type of poor extrusion processing is evidenced by erratic extrusion pressures, extruder amperage and variation in the rate the polymer is extruded. In the extreme this can be evidenced by the complete loss of forwarding of resin in the extruder and a complete stoppage of extrusion of the resin.

It would be desirable to use such polymers as vinylidene chloride/methyl acrylate polymers in monofilament applications because the vinylidene chloride/methyl acrylate copolymer, for instance, can have higher tensile strength, higher modulus, or both than the vinylidene chloride/vinyl chloride counterpart. It would, therefore, be desirable to have an additive or additive package and comonomer content for polyvinylidene chloride compositions, especially compositions comprising copolymers of vinylidene chloride and methyl acrylate, which additive or package would improve at least one of crystallization rate or extrusion processing, preferably sufficiently to render them more suitable for such applications as monofilament fibers. However, it was found that olefin process aids typically used for extrusion of vinylidene chloride copolymers with methyl acrylate to form other articles such as films or sheets did not work in monofilament because they tended to bloom to the surface.

SUMMARY OF THE INVENTION

It has now been found that a combination of limiting the methyl acrylate in a polyvinylidene chloride polymer to at most about 6 percent and using a plasticizer in an amount of at least about 3 percent results in a polymer that has a desirable combination of short reaction time and fast crystallization, that is a reaction time shorter than that of the formation of a polymer of vinylidene chloride and vinyl chloride with the same percentage of vinylidene chloride in the final polymer. These changes provide sufficient extrusion processing characteristics for some extrusion equipment. However, it has been found that extrusion processing is further improved by addition of certain methacrylic polymers. Use of two types of plasticizer further improves extrusion processing characteristics.

In the first aspect, this invention is a monofilament obtainable by extruding a composition comprising (a) at least one vinylidene chloride polymer/methyl acrylate interpolymer having at most about 6 weight percent methyl acrylate mer units in the polymer; and (b) at least about three weight percent total plasticizer, of which at least about 0.5 weight percent based on total composition weight is an epoxy plasticizer or combination thereof. Optionally, the composition also comprises additives (c) at least one ester plasticizer in an amount of at least about 0.5 weight percent based on total composition weight, which amount of ester plasticizer is included in the amount of total plasticizer;

(d) at least one UV light stabilizer in an amount of at least about 0.25 weight percent based on weight of the composition; or (e) at least one methacrylic polymer formed from a monomer composition (that is, having mer units originating from a monomer composition) consisting essentially of alkyl methacrylate ester monomers, alkyl acrylate ester monomers, styrenic monomers or a combination thereof in an amount sufficient to achieve more uniform feeding through an extruder than is achieved in its substantial absence, preferably in an amount of at least about 0.2 percent based on weight of the composition or a combination of more than one of additive of type (c), (d), or (e) or a combination of 2 or more of these types of additives. The composition optionally includes additives in addition to those listed; however, the weight percentages are those determined from the weight of the vinylidene chloride interpolymer and the listed types of additives, including more than one of one or more of each type of listed additive (b) through (e). Independently, the total amount of plasticizer is preferably at most about 10 weight percent of the composition. Independently, the methacrylic polymer comprises at least a portion, preferably greater than about 30 weight percent of mer units from methacrylate monomers, most preferably methyl methacrylate.

In a second aspect, this invention includes a process for producing monofilament comprising extruding a composition comprising (a) at least one vinylidene chloride polymer/methyl acrylate interpolymer having at most about 6 weight percent methyl acrylate mer units in the polymer; and (b) at least about 3 weight percent total plasticizer, of which at least about 0.5 weight percent based on total composition weight is an epoxy plasticizer or combination thereof through a die such that monofilament is formed.

DRAWINGS

There are no drawings

DETAILED DESCRIPTION OF THE INVENTION

Definition of Terms

The term "plasticizer" as used herein refers to a substance or material incorporated into a polymer composition to increase the flexibility, pliability or softness of the polymer or a final product made from it, for instance a film or fiber. Usually, a plasticizer lowers the glass transition temperature of the plastic, making it softer. However, strength and hardness often decrease as a result of added plasticizer.

The term "processability" is used herein to refer to characteristics exhibited in extrusion processing of a resin including resin thermal stability and consistency of feeding or extrusion rates. In this invention, the extrusion referred to is preferably that in an extruder for making monofilament.

The term "processing aid" as used herein refers to additives useful to improve extrusion of a polymer to form a monofilament, thus extrusion processing aids. More particularly, for the purposes of this invention, improving processability using a processing aid refers to improving melting behavior in the melting and forwarding portions of an extruder screw. Specifically, an effective processing aid for use in the practice of the invention is one which aids in the consistent melting of the polymer in the extruder screw resulting in uniform melting and extrusion of the resin. It is noted that the term "processing aid" is sometimes used more broadly to include, for instance, compounds that act as lubricants in other aspects of processing. Some such lubricants, such as silicon oil, are not effective for improving melting characteristics in the melting and forwarding portion of an extruder screw.

"Glass transition temperature" (Tg) is the temperature at which the transition from a liquid to an amorphous or glassy solid occurs when a substance is cooled. This transition occurs if the cooling rate is so fast that normal crystallization is prevented. In the case of methacrylic polymers, like most polymers, the glass transition temperature is measured by differential scanning calorimetry.

As used herein the term "strength" when not otherwise modified refers to tensile strength.

The term "tensile strength" refers to the maximum amount of stress that can be applied to a material before rupture or failure. The tensile strength is measured, for instance, by the procedures of ASTM D882.

The term "modulus" as used herein is the tensile modulus. It refers to the property commonly perceived as hardness and is optionally referred to as hardness. Modulus is measured according to the procedures of ASTM D882.

The term "viscosity" is used to characterize the melt flow characteristics of (or the flowability of) a polymer. This viscosity, also known as shear viscosity is measured by the procedure of Kun Sup Hyun, "Melt Rheology of Vinylidene Chloride-Vinyl Chloride Copolymers," Journal of Vinyl Technology, Vol. 8, No. 3, Pg. 103-106 (September 1986). Shear viscosity is used to indicate the force which will be needed to push the polymer through a limited opening like an extruder die. A higher shear viscosity indicates that a larger force is required to push the polymer resin through processing equipment, such as an extruder die, and a lower shear viscosity indicates that a lower force is required to push the polymer through processing equipment.

Productivity is used herein to refer to pounds of resin produced per unit of time per unit of reactor volume. Productivity of a vinylidene chloride polymer is considered high when it is greater than that of common vinylidene chloride/vinyl chloride polymer produced using an amount of vinyl chloride monomer which is the molar equivalent of the amount of comonomer in the polyvinylidene chloride being compared.

The term "crystallization" as used herein means the rearrangement of a portion of polymer molecules into more organized, denser structures commonly called crystallites, as measured by differential scanning calorimetry. Polymer crystallization normally occurs during, the formation of a fiber or any other transformation of a semi-crystalline polymer from the molten to solid state. Crystallization is considered fast for the purposes of this invention when it occurs in the time scale of the fiber drawing process.

The term "filament", as used herein shall refer to a single, continuous or discontinuous elongated strand formed from one or more metals, ceramics, polymers or other materials and that has no discrete sub-structures (such as individual fibers that make up a "thread" as defined above). "Filaments" can be formed by extrusion, molding, melt-spinning, film cutting, or other known filament-forming processes. A "filament" differs from a "thread" in that a filament is, in essence, one continuous fiber or strand rather than a plurality of fibers that have been carded or otherwise joined together to form a thread. "Filaments" are characterized as strands that are longer than 25 mm, and may be as long as the entire length of yarn (for instance, a monofilament).

The term "monofilament" is used herein to refer to a thread or fiber construction produced from a single continuous filament, in most instances having a generally circular cross section, optionally hollow, resembling fishing line or hollow line. For the purposes of this invention, a monofilament preferably has a diameter of at most about 3 mm, preferably at most about 2 mm, more preferably at most about 1.5 mm, most preferably at most about 0.5 mm; and independently preferably at least about 0.05 mm, more preferably at least about 0.1 mm, most preferably at least about 0.15 mm. For the purposes of this invention, monofilament preferably has a length of at least about 1 m, more preferably at least about 10 m, most preferably at least about 100 m as formed.

"Molecular weight" is used herein to designate the weight average molecular weight in Daltons. It is measured by size exclusion chromatography using polystyrene calibration. Sample preparation includes dissolving a polyvinylidene chloride resin sample in tetrahydrofuran (THF) at 50° C. Resin samples containing more than about 94 percent vinylidene chloride do not readily dissolve at this temperature, and dissolving at elevated temperature can result in degradation of the polymer molecular weight. Therefore, resin samples containing more than about 94 percent vinylidene chloride are pre-dissolved as a 1 percent (%) solution, in inhibited THF at 63° C. Samples can be dissolved at up to 83° C. for 4 hours without loss of molecular weight, though minimizing dissolving time and temperature is desirable. The polymers are then analyzed for determination of molecular weight by gel permeation chromatography (GPC) using the Polymer Laboratories Software on a Hewlett Packard 1100 chromatograph equipped with two columns in series. These columns contain 5 μm Styrene/divinylbenzene copolymer beads commercially available from Polymer Laboratories under the trade designation PLGel 5μ MIXED-C. The solvent is nitrogen purged HPLC Grade THF. The flow rate is 1.0 milliliter/minute and the injection size is 50 microliters. The molecular weight determination is deduced by using ten narrow molecular weight distribution polystyrene standards (commercially available from Polymer Labs under the trade designation Narrow PS set (~3,000,000 to 2000 Mp)) in conjunction with their elution volumes.

"Extrusion," and "extrude," refer to the process of forming continuous shapes by forcing a molten plastic material through a die, followed by cooling or chemical hardening. Immediately prior to extrusion through the die, the relatively high-viscosity polymeric material is fed into a rotating screw, which forces it through the die. Unless stated otherwise in the description of this invention, the extrusion is as applied to equipment for making monofilament.

"Coextrusion" and "coextrude" refer to the process of extruding two or more materials through a single die with two or more orifices arranged so that the extrudates merge and weld together into a laminar structure before cooling or chilling, that is, quenching. Coextrusion is often employed as an aspect of other processes, for instance, in film blowing, casting film, and extrusion coating processes.

The term "extruder" is used herein to denote any apparatus which receives material, preferably in bulk form, for instance pellets, and coveys it through at least one shaping means such as at least one die. When the material is received in a solid state, it is melted in the extruder. In the practice of the invention, the material is a composition comprising polyvinylidene chloride, which is advantageously extruded to form a monofilament. The extruder comprises at least one screw, rotatable along its longitudinal axis, within a defined space referred to as a barrel. The barrel has a generally cylindrical or frustroconical shape or a combination of such shapes, in sequence, axially aligned. The screw has a longitudinal shaft (also called root) with helical thread, referred to herein as the flight, formed thereon, which on rotation of the shaft moves in close proximity to and with a small clearance from the inner surface of the bore of the barrel defining with said barrel a helical channel. The extruder has plural zones, including at least one zone where material is supplied, conveniently via at least one inlet, and advanced (referred to herein as the feed zone, also known as the conveying zone) and at least one zone where the material is advanced toward a die (referred to herein as the metering zone, also known as the pumping zone). Between the feed and metering zones, there is conveniently at least one transition zone. In a preferred embodiment, the channel is deeper in the feed zone than it is in the metering zone. In the transition zone, the depth of the channel progressively changes from that of the feed zone to that of the metering zone. Variation in channel depth preferably is accomplished by variation of barrel diameter (larger to form larger channel) or, alternatively, by variation of screw shaft diameter (larger to form smaller channel) or both. In the feed zone, material is moved from the inlet toward the die and encounters friction and, optionally, other heat, that begins to melt or plasticate the material. In a transition zone, also referred to as a compression zone, the material is compressed and, thus, placed under pressure. Melting is usually completed in this zone. In the metering zone, material is preferably further mixed to from a smooth consistent melt having a uniform temperature. The metering zone serves to uniformly pump the melted material out through the die or other shaping means. There are optionally other zones, for instance, devolatilizing, vent or barrier zones. Furthermore, the feed, transition, metering and other zones are optionally subdivided into more than one zone. For simplicity, the discussion herein shall describe single feed, transition and metering zones, but the invention is not limited to such a simple extruder. The space ahead of a flight, that is, on the die side of a flight, is referred to as the pushing side and behind the flight, on the feed side, is referred to as the trailing side. An extruder with a constant screw shaft size and varying size of bore of the barrel (the more commonly used type of extruder for forming monofilament) has the following characteristics: a diameter D measured from the outer edge of one flight through the center of the shaft to a point even with the outer edge of an opposite flight; a helix angle of flight pitch $\Phi$ which is the angle formed between the plane perpendicular to the longitudinal axis of the shaft and the helical path of the spiral along the shaft; a flight height of the feed zone $h_f$ measured as the distance between the outside of the screw shaft and the closest inner surface of the barrel in the feed zone; a flight height of the metering zone $h_m$ measured as the distance between the outside of the screw shaft and the closest inner surface of the barrel in the metering zone, in case of variation, in the first flight of the metering zone; a length L between the trailing edge of one flight and the trailing edge of the adjacent flight; compression ratio is the ratio of $h_f/h_m$; flight height to diameter ratio is $h_f/D$ or $h_m/D$; a section depth (another term for flight height defined as $h_f$ or $h_m$); a flight width which is measured between the trailing side of a flight and the pushing side of the flight; an optional axial dam, which is a protrusion or extension that extends axially from the root of the screw into the space between the screw and barrel in at least one channel covering the entire width of the channel. The number of flights in a zone is the number of sections of flight that would be seen in a cut away view of the zone, which is the number of times the flight encircles the shaft in a zone; and the number of channels in a zone is the number of channels between flights; thus, 5 flights define 4 channels when a zone begins and ends with a flight. Channels and flights are numbered consecutively from the beginning of the feed end to the die end of the screw. When the screw diameter D equals flight length L the screw is said to have "square pitch." An important dimension in screw design is the channel depth (or root depth) as measured from the root (shaft) of the screw to the top of the flight. When an extruder has more than one feed or metering zone, or channel depth varies within a zone, calculations like compression ratio are based on the average depth of the feed section divided by the average depth of the metering section. These terms used herein to describe extruders apply to various configurations of extruders and are used herein as they are within the art; therefore, reference is suitably made to drawings of extruder screws within the art, especially the art of extrusion to make monofilament, such as Rauwendaal, "Extrusion" in Encyclopedia of Polymer Science and Technology, online ed., John Wiley (2002, last updated 27 May 2008, as accessed 11 Jun. 2008) v.2, pages 497-558. See also, Wessling, Gibbs, Obi, Beyer, DeLassus and Howell "Vinylidene Chloride Polymers" in *Encyclopedia of Polymer Science and Technology*, online ed., John Wiley (2002, last updated 27 May 2008, as accessed 11 Jun. 2008) v.4, pages 458-510. See, http://www.mrw.interscience.wiley.com/emrw/0471440264/home/.

As used herein, the term "mer unit" means that portion of a polymer derived from a single reactant molecule, a single monomer molecule; for example, a mer unit from ethylene has the general formula —$CH_2CH_2$—.

As used herein "polymer" is a molecule having repeating mer units from more than 200 monomer molecules, which molecules are optionally the same or different. Interpolymers or copolymers have at least 2 types of mer units, that is, they are prepared from at least two different monomers, referred to as comonomers.

As used herein, the term "PVDC" designates polyvinylidene chloride copolymers. Common PVDC copolymers include vinylidene chloride/vinyl chloride copolymer and vinylidene chloride/methyl acrylate copolymer.

All percentages, preferred amounts or measurements, ranges and endpoints thereof herein are inclusive, that is, "less than about 10" includes 10 and about 10. "At least" is, thus, equivalent to "greater than or equal to," and "at most" is, thus, equivalent "to less than or equal to." Unless stated otherwise, numbers herein have no more precision than stated. Thus, "115" includes at least from 114.5 to 115.49. Furthermore, all lists are inclusive of combinations of two or more members of the list. All ranges from a parameter described as "at least," "greater than," "greater than or equal to" or similarly, to a parameter described as "at most," "up to," "less than," "less than or equal to" or similarly are preferred ranges regardless of the relative degree of preference indicated for each parameter. Thus, a range that has an advantageous lower limit combined with a most preferred upper limit is preferred for the practice of this invention. All amounts, ratios, proportions and other measurements are by weight unless stated otherwise, implicit from the context, or customary in the art. All percentages refer to weight percent based on total composition according to the practice of the invention unless stated otherwise, implicit from the context, or customary in the art. Except in the examples, or where otherwise indicated, all numbers expressing quantities, percentages, OH numbers, functionalities and so forth in the specification are to be understood as being modified in all instances by the term "about." Unless stated otherwise or recognized by those skilled in the art as otherwise impossible, steps of processes described herein are optionally carried out in sequences different from the sequence in which the steps are discussed herein. Furthermore, steps optionally occur separately, simultaneously or with overlap in timing. For instance, such steps as heating and admixing are often separate, simultaneous, or partially overlapping in time in the art. Unless stated otherwise, when an element, material, or step capable of causing undesirable effects is present in amounts or in a form such that it does not cause the effect to an unacceptable degree it is considered substantially absent for the practice of this invention. Furthermore, the terms "unacceptable" and "unacceptably" are used to refer to deviation from that which can be commercially useful, otherwise useful in a given situation, or outside predetermined limits, which limits vary with specific situations and applications and can be set by predetermination, such as performance specifications. Those skilled in the art recognize that acceptable limits vary with equipment, conditions, applications, and other variables but can be determined without undue experimentation in each situation where they are applicable. In some instances, variation or deviation in one parameter can be acceptable to achieve another desirable end.

The term "comprising", is synonymous with "including," "containing," or "characterized by," is inclusive or open-ended and does not exclude additional, unrecited elements, material, procedures or steps, whether or not the same are disclosed herein. The term "consisting essentially of" indicates that in addition to specified elements, materials, procedures or steps; unrecited elements, materials procedures or steps are optionally present in amounts that do not unacceptably materially affect at least one basic and novel characteristic of the subject matter. The term "consisting of" indicates that only stated elements, materials, procedures or steps are present except to an extent that has no appreciable effect, thus are substantially absent.

The term "or", unless stated otherwise, refers to the listed members individually as well as in any combination of some or all of the listed members.

Expressions of temperature are optionally in terms either of degrees Fahrenheit (° F.) together with its equivalent in degrees centigrade (° C.) or, more typically, in degrees centigrade (° C.) alone.

The present invention involves compositions of at least one vinylidene chloride polymer.

Vinylidene chloride polymers (also known as vinylidene chloride resins, interpolymers of vinylidene chloride, vinylidene chloride interpolymers, copolymers of vinylidene chloride, and PVDC) are well-known in the art. See, for example, U.S. Pat. Nos. 3,642,743 and 3,879,359. As used herein, the term "interpolymer of vinylidene chloride," vinylidene chloride interpolymer" or "PVDC" encompasses copolymers, terpolymers, and higher polymers wherein the major component is vinylidene chloride, optionally and preferably having one or more mono-ethylenically unsaturated monomer (monounsaturated comonomer) copolymerizable with the vinylidene chloride monomer such as vinyl chloride, alkyl acrylates, alkyl methacrylates, acrylic acid, methacrylic acid, itaconic acid, acrylonitrile, and methacrylonitrile.

This invention is particularly applicable to methyl acrylate vinylidene chloride polymers (PVDC/MA). The vinylidene chloride polymer comprises monomer units from vinylidene chloride and methyl acrylate. In another embodiment, methyl acrylate is preferred because methyl acrylate results in desirably high modulus and tensile strength. In an alternative embodiment, the vinylidene chloride polymer optionally also has at least one additional monounsaturated comonomer polymerizable with vinylidene chloride and an alkyl acrylate, such as vinyl chloride, alkyl methacrylates, acrylic acid, methacrylic acid, itaconic acid, acrylonitrile, methacrylonitrile, and combinations thereof, preferably alkyl methacrylates, acrylic acid, methacrylic acid, itaconic acid, acrylonitrile, methacrylonitrile, or combinations thereof.

Preferably, the vinylidene chloride interpolymer is formed from a monomer mixture comprising a vinylidene chloride monomer preferably in an amount of at least 94, more preferably at least about 95, and independently advantageously at most about 97, preferably at most about 96.5, more preferably at most about 96 and most preferably at most about 95.5 weight percent of the monomers in a polymer. More specifically, the preferred amounts of vinylidene chloride are the remainder when the preferred amounts of monounsaturated comonomer are present. In general, the monounsaturated comonomer, preferably methyl acrylate, is advantageously used in an amount of at least about 3, preferably at least about 3.5, more preferably at least about 4, most preferably at least about 4.5 weight percent, and advantageously at most about 6, preferably at most about 5 weight percent based on total vinylidene chloride interpolymer.

The vinylidene chloride polymer advantageously has a molecular weight sufficient to form a fiber having the desired tensile strength, that is, preferably at least about 50,000, more preferably at least about 65,000, most preferably about 80,000 and independently preferably at most about 200,000, more preferably at most about 150,000, most preferably at most about 100,000 Daltons.

The vinylidene chloride polymer compositions of the invention preferably comprise at least one plasticizer.

Compositions containing at least one vinylidene chloride copolymers of the invention contain at least one plasticizer. Such plasticizers include epoxidized oils such as epoxidized soybean oil or epoxidized linseed oil; aliphatic or aromatic ester plasticizers within the skill in the art such as dibutyl sebacate; acetyl tributyl citrate (ATBC); other polymeric or high molecular weight ester oils, advantageously having a molecular weight of at least about 300; and combinations thereof.

The total amount of plasticizers is preferably at least about 3, more preferably at least about 5, most preferably at about 6 percent, and independently preferably at most about 10, more preferably at most about 9, most preferably about 8 percent plasticizer based on total weight of the polyvinylidene chloride composition. Of this, an amount of at least about 0.5, more preferably at least about 1, most preferably at least about 2 and independently preferably at most about 10, more preferably at most about 9, most preferably at most about 8 percent based on total weight of the polyvinylidene chloride composition is preferably epoxidized oil plasticizer. In the practice of the invention at least two types of plasticizer are preferably present, more preferably at least one epoxy plasticizer and at least one ester plasticizer. The ester plasticizer or combination of ester plasticizers preferably makes up the remainder of the preferred amount of plasticizer.

In addition to the plasticizer or combination of plasticizers the compositions of the invention preferably contain at least one UV stabilizer, that is, any compound capable of protecting the polymer from deterioration in the presence of UV light, preferably a UV absorber, such as 2-hydroxy-4-methoxybenzophenone, 2-hydroxy-4-noctoxybenzophenone, 2-(2H-benzotrazol-2-yl)-p-cresol, 2-(2'-hydroxy-5'-octylpnenyl)-benzotriazole, 2-(2H-benxotrazol-2-yl)-4,6-ditert-pentylphenol, 2-(2'-hydroxy-3',5'-di-t-amylphenyl)benzotriazole, 2-[4,6-bis(2,4-dimethylphenyl)-1,3,5-triazin-2-yl]-5-(octyloxy)phenol or a combination thereof. The UV stabilizer is present in an amount of preferably at least about 0.25, more preferably at least about 0.5, and independently preferably at most about 4, more preferably at most about 3 percent based on total composition including polymer and additives. Most preferred amounts vary with type of stabilizer, for instance when 2-hydroxy-4-noctoxybenzophenone or 2-hydroxy-4-methoxybenzophenone or a combination thereof is used, at least about 1 percent is most preferred and independently at most about 3 is most preferred. When 2-(2H-benzotrazol-2-yl)-p-cresol, 2-(2'-hydroxy-5'-octylpnenyl)-benzotriazole, 2-(2H-benxotrazol-2-yl)-4,6-ditert-pentylphenol, 2-(2'-hydroxy-3',5'-di-t-amylphenyl)benzotriazole or a combination thereof are used, at least about 0.25 percent is most preferred and independently at most about 2 is most preferred. When 2-[4,6-bis(2,4-dimethylphenyl)-1,3,5-triazin-2-yl]-5-(octyloxy)phenol is used, at least about 0.25 percent is most preferred and independently at most about 2 is most preferred.

Furthermore, in a preferred embodiment, the practice of the invention involves addition of methacrylic polymer to achieve more uniform feeding through an extruder than is achieved in its substantial absence, that is, in the same formulation except without added methacrylic polymer. The methacrylic polymer is a polymer preparable from monomers comprising at least one alkyl methacrylate monomer, or a combination thereof, optionally with at least one alkyl acrylate or styrenic monomer or a combination thereof; that is, having mer units from the alkyl methacrylate monomer or monomers and optionally from alkyl acrylate monomer or monomers. Preferably, the methacrylic polymer comprises methyl methacrylate, more preferably in an amount of at least about 30, more preferably at least about 40, most preferably at least about 50 weight percent, and at least one additional methacrylic or acrylic alkyl ester or styrenic monomer or combination thereof, more preferably comprising at least one additional methacrylic or acrylic alkyl ester. The alkyl groups of the alkyl acrylate and methacrylate monomers have at least 1 carbon atom and independently preferably at most about 16 carbon atoms, more preferably at most about 8, most preferably at most about 4 carbon atoms. Preferred methacrylate and acrylate ester monomers, especially for copolymerization or interpolymerization with methyl methacrylate include such monomers as methyl acrylate, ethyl acrylate, butyl acrylate, ethyl methacrylate, butyl methacrylate and combinations thereof. Preferred styrenic monomers include such monomers as styrene, alpha methyl styrene, para methyl styrene, para tert-butyl styrene and combinations thereof. Methacrylate and acrylate monomers and combinations thereof are more preferred.

The methacrylic polymer advantageously has a molecular weight effective in achieving uniform polymer feeding through an extruder, preferably a molecular weight of at least about 100,000, more preferably at least about 150,000 and most preferably at least about 200,000 and independently preferably at most about 4,000,000, more preferably at most about 700,000, most preferably at most about 400,000 Daltons. Similarly, the glass transition temperature is advantageously in a range effective for achieving uniform polymer feeding through an extruder. The methacrylic polymer preferably has at least one glass transition temperature of less than about 105° C., more preferably less than about 95° C. and independently preferably at least about 30° C. More preferably, the methacrylic polymer processing aid has one glass transition temperature between about 30° C. and about 105° C., more preferably between about 30° C. and about 95° C. and a second glass transition temperature, which is most preferably below about 40° C., more preferably below about 30° C. The methacrylic polymer processing aids are preferably produced by emulsion polymerization and are optionally either random or segmented copolymers leading to one or more glass transition temperatures.

In the practice of the present invention the methacrylic polymer, when used, is preferably present in an amount effective to achieve more uniform feeding through an extruder than is achieved in its substantial absence, that is, in the same formulation except without added methacrylic polymer. Preferably the amount is at least about 0.2 percent, more preferably at least about 0.25 percent, most preferably at least about 0.5 percent and independently advantageously at most about 4 percent, preferably at most about 1.99 percent, more preferably at most about 1 percent, most preferably at most about 0.99 percent by weight based on weight of the total vinylidene chloride polymer composition including additives and methacrylic polymer.

The methacrylic polymer is optionally added and admixed with the vinylidene chloride polymer as the other additives are added, for instance by mechanical admixing, or is coagulated onto the polyvinylidene chloride polymer as is within the skill in the art and is described in U.S. Pat. No. 6,627,679 which is incorporated herein by reference to the fullest extent permitted by law. Other additives are optionally combined with the methacrylic polymer and coagulated onto the vinylidene chloride polymer with it as described in U.S. Pat. No. 6,627,679.

In many embodiments, sufficiently uniform feeding of the polymer through an extruder is observed without the use of a methacrylic polymer. In these instances, limiting the methyl acrylate in the vinylidene chloride polymer to less than about 6 weight percent and using at least about 3 weight percent of plasticizer, of which at least about 0.5 weight percent based on weight of vinylidene chloride polymer composition is epoxy plasticizer is sufficient. The present invention includes use of the methacrylic polymer processing aid when it is needed, that is when feeding of the vinylidene chloride/methyl acrylate polymer composition is insufficiently uniform without it, especially when the polymer stream breaks or is not fed without the methacrylic polymer. The methacrylic polymer processing aid is particularly useful in extruders having at least one of (a) fewer than 4 flights in the feed zone (preceding the transition zone to the metering zone), preferably fewer than about 3, more preferably fewer than about 2; (b) greater than 6 flights in the feed zone, preferably more than about 7, more preferably more than about 8; (c) a feed section height to diameter ratio less than about 0.208, preferably less than about 0.203, more preferably less than about 0.200; or (d) a compression ratio less than about 3.7, preferably less than about 3.5, more preferably less than about 3.3. The methacrylic polymer is increasingly useful where at least 2, preferably at least 3, more preferably at least 4 of these characteristics are found in the extruder. When these conditions are not met, the methacrylic polymer processing aid is often not needed, therefore, preferably not used.

A variety of other additives within the skill in the art are optionally incorporated into the vinylidene chloride polymer. Additive type and amount will depend upon several factors. One such factor is the intended use of the composition. A second factor is tolerance of the composition for the additives. That is, amount of additive that can be added before physical properties of the blends are adversely affected to an unacceptable level. Other factors are apparent to those skilled in the art of polymer formulation and compounding.

Exemplary additives include heat or thermal stabilizers, acid scavengers, pigments, processing aids, lubricants, fillers, and antioxidants. Each of these additives is within the skill in the art and several types of each are commercially available. Preferably, the vinylidene chloride polymer composition in addition to the additives according to the practice of the invention contains only additives commonly used such as the listed types.

Exemplary lubricants include fatty acids, such as stearic acid; esters, such as fatty esters, wax esters, glycol esters, and fatty alcohol esters; fatty alcohols, such as n-stearyl alcohol; fatty amides, such as N,N'-ethylene bis stearamide; metallic salt of fatty acids, such as calcium stearate, and magnesium stearate; and polyolefin waxes, such as paraffinic, and oxidized polyethylene. Paraffin and polyethylene waxes and their properties and synthesis are described in 24 Kirk-Othmer Encyc. Chem. Tech. 3rd Ed., Waxes, at 473-77 (J. Wiley & Sons 1980), which is incorporated herein by reference.

Additives are conveniently incorporated into vinylidene chloride interpolymer compositions using any mixing process that does not have substantial adverse effects on the vinylidene chloride polymer or additives, preferably dry blending techniques, alternatively melt blending or other means within the skill in the art. It is within the practice of the invention to incorporate additives and components with the polymer and other additives in any sequence. Preferred methods of combining components include in-situ mixing of additives into the polymerization train during the polymerization or finishing steps of the vinylidene chloride interpolymer, dry blending of the finished vinylidene polymer with the additives in a post reaction operation with blenders of various configuration and mixing intensity, melt blending or cofeeding additives and the vinylidene interpolymer directly to an extruder and the like and combinations thereof.

Compositions of the invention include combinations of the additives (for instance, plasticizer, methacrylic polymer, and, optionally, UV stabilizer) alone or in combination with at least one polyvinylidene chloride. The resulting vinylidene chloride polymer compositions are useful for any of the uses within the skill in the art for polyvinylidene chloride. They are especially useful for forming fibers, particularly monofilament fibers. Such monofilament fibers are useful in many applications including, for instance, shower curtains, doll hair, filter media, shoe insoles, and the like.

Monofilaments, are suitably formed by any process within the skill in the art for making polyvinylidene chloride fibers, such as those taught in such references as E. D. Serdynsky, "Polyvinylidene Chloride Fibers" in H. F. Mark, S. M. Atlas and E. Cernia eds., Man Made Fibers, Vol. III, Interscience, N.Y. (1968) pages 303-326 and U.S. Pat. No. 2,233,442 which are incorporated herein to the fullest extent permitted by law. Thus a process according to the practice of the invention of forming a monofilament strand comprising steps of (a) supplying a composition suitable for extruding a monofilament of the invention to an extruder; preferably also (b) extruding the composition through a die having at least one hole having a diameter of at most about 120 mm, preferably at most about 100 mm, more preferably at most about 50 mm, most preferably at most about 2 mm; and independently preferably at least about 0.2 mm, more preferably at least about 0.3 mm, most preferably at least about 0.6 mm.

Objects and advantages of this invention are further illustrated by the following examples. The particular materials and amounts thereof, as well as other conditions and details, recited in these examples should not be used to limit this invention. Rather they are illustrative of the whole invention. Unless stated otherwise all percentages, parts and ratios are by weight.

EXAMPLES

Examples 1-5

A set of samples are prepared by blending a vinylidene chloride/methyl acrylate copolymer with a methacrylic polymer in the amounts indicated in Table 1. The vinylidene chloride/methyl acrylate is a copolymer containing 4.8 weight percent methyl acrylate and having a molecular weight of 91,000 Mw (determined using polystyrene calibration) and containing 3.0 weight percent epoxidized soybean oil, 4.0 weight percent acetyl tributyl citrate and 1.8 weight percent hydroxybenzophenone. The methacrylic polymer is a butyl acrylate/butyl methacrylate/methyl methacrylate terpolymer (wherein the monomers are believed to be present in the ratio of 19/29/53 percent with an error of about 10 percent) having a molecular weight of about 223,000, a larger glass transition temperature at about 73° C. and a smaller one at about 29° C., commercially available from Arkema under the trade designation PLASTISTRENGTH™ L-1000. Blend compositions shown in Table 1 are produced by blending the two polymers in a high intensity power mixer commercially available from Welex, Inc. under the trade designation Model #35 M, high intensity mixer at 600 rpm for about 1 minute at ambient temperature.

Each of the polymer blends are tested for extrusion stability by extruding on a 1.75 inch (4.45 cm) diameter extrusion line, commercially available from Macroplast under the trade designation Macro model ME452020. The extrusion line has a length to diameter ratio of 20/1, 3 temperature zones, adapter and die. The screw design for this line has 4 feed flights with a 0.355" depth, 0.203 height to diameter ratio and a square pitch. The screw has 10 transition flights and 7 metering flights, with the metering flights being 0.096" deep. The screw compression ratio is 3.7 and the extruder has an axial dam with a 0.030" gap between the top and the barrel located in channel 14. The extruder has a feed throat for the purpose of introducing polymer and optionally other materials distal to the extrusion die. The feed throat is cooled to 12° C. and all extruder zone temperatures and adapter are set to 175° C. The die temperature is set to 165° C. The extruder rpm is set to either 25 or 50 rpm (see Table 1). Extrusion stability is determined by monitoring the amperage fluctuation. The extrusion line is equipped with a strip chart recorder that monitors this amperage fluctuation. Data reported in Table 1 are the range of amperage fluctuation as measured 0 to 100 percent of scale on the chart recorder. A large variation, that is, greater than about 10 percent indicates that the resin is not feeding uniformly. A smaller variation indicates that the resin is feeding sufficiently uniformly to form uniform monofilament.

Example 6a

The vinylidene chloride/methyl acrylate copolymer of Example 1 is extruded in the same manner without added methacrylic polymer. As shown in Table 1 this resin gives high amperage fluctuation at 25 rpm and will not feed at all at 50 rpm.

TABLE 1

Extrusion Data for Examples (Ex) 1-6a

| | Extruder rpm | amount of methacrylic polymer percent of composition | amperage range in percent of scale |
|---|---|---|---|
| Ex 1 | 25 | 0.25 | 18 |
| Ex 2 | 25 | 0.5 | 10.5 |
| Ex 3 | 25 | 1 | 4 |
| Ex 4 | 25 | 1.5 | 8 |
| Ex 5 | 25 | 2 | 3 |
| Ex 6a | 25 | 0 | 27.6 |
| Ex 1 | 50 | 0.25 | 9 |
| Ex 2 | 50 | 0.5 | 11 |
| Ex 3 | 50 | 1 | 2 |
| Ex 4 | 50 | 1.5 | 1.5 |
| Ex 5 | 50 | 2 | 2 |
| Ex 6a | 50 | 0 | no feed |

Example 6b

Although the data in Table 1 shows that the methacrylic polymer processing aid is important for extruding the composition through the extruder described in Example 1 under the conditions described therein, the material of Example 6a is extruded on an extruder commercially available from Welex, Inc. under the trade designation Welex Model 1.75.18-1. This extrusion line includes a 1.75" (4.45 cm) extruder. The extruder screw has 6 feed flights with a 0.355" (0.9 cm) depth, 0.209 height to diameter ratio and a square pitch. The screw has 8 transition flights and 7 metering flights, with the metering flights being 0.098" (0.25 cm) deep. The screw has a compression ratio of 3.72 and has an axial dam with a 0.030" (0.8 cm) gap between its top and the barrel located in channel 14. All extruder zone temperatures, adapter and die are set to 165° C. The extruder rpm is set to either 25 or 50 rpm. Extrusion stability is determined by monitoring the amperage and pressure fluctuation. Both extruder amperage and pressures are steady and the extrusion rate is consistent at 25 lb (11.34 kg)/hour at 25 rpm and 50-52 pounds (22.68 to 23.59 kg)/hour at 50 rpm.

Thus, the composition is useful, even without methacrylic polymer processing aid for extrusion to form monofilament on some extruders, although not on the extruder used in Examples 1-6a.

Example 6c

The procedure of Example 1 is repeated except that the 0.25 weight percent of the methacrylic polymer used in Example 1 is replaced by 0.1 weight percent of the same polymer. This resin is extruded in the same manner as Example 1. The sample would not feed at 25 rpm. This shows that when methacrylic polymer is used, 0.1 weight percent, at least with the described equipment, is insufficient to impart sufficient improvements in processing. However, Example 6b shows that even without the methacrylic polymer, the composition will extrude well in other equipment.

Example 7

A vinylidene chloride/methyl acrylate copolymer containing 4.8 percent methyl acrylate and having a molecular weight of 91,000 Mw (polystyrene calibration) and containing 1.0 percent epoxidized soybean oil, 5.8 percent acetyl tributyl citrate is extruded in the same manner as Example 6b. Extrusion stability is determined by monitoring the amperage and pressure fluctuation. Both extruder amperage and pressures are steady and the extrusion rate is consistent at 25 pounds (11.34 kg)/hour at 25 rpm and 50 pounds (22.68 kg)/hour at 50 rpm. This example shows the composition is useful, even without methacrylic polymer processing aid for extrusion to form monofilament on some extruders Example 8

The procedure of Example 1 is repeated except that the 0.25 weight percent of the methacrylic polymer used in Example 1 is replaced by 1 weight percent of a methyl methacrylate/ethyl acrylate copolymer having a molecular weight of about 700,000, a glass transition temperature at about 85° C. commercially available from Arkema under the trade designation PLASTISTRENGTH™ 501. This resin is extruded in the same manner as Example 1. The amperage range is 5.5 at 50 rpm. This example shows that a methacrylic polymer other than that of Example 1 is useful in the practice of the invention.

Example 9

The procedure of Example 1 is repeated except that the 0.25 weight percent of the methacrylic polymer used in Example 1 is replaced by 1 weight percent of a methyl methacrylate/butyl acrylate copolymer having a molecular weight of about 1,500,000, a glass transition temperature at about 65° C. commercially available from Arkema under the trade designation PLASTISTRENGTH™ 551. This resin is extruded in the same manner as Example 1. The amperage range is 6.5 at 50 rpm. This example shows feeding stability necessary to make uniform diameter monofilaments with yet another methacrylic polymer.

Embodiments of the invention include the following:

1. A monofilament obtainable by extruding a composition comprising (or a monofilament comprising):
   (a) at least one vinylidene chloride polymer/alkyl acrylate interpolymer having at most about 6 weight percent alkyl acrylate mer units in the polymer; and
   (b) at least about three weight percent total plasticizer, of which about 0.5 weight percent based on total composition weight is an epoxy plasticizer or combination thereof through a die such that monofilament is formed.
2. A process for producing monofilament comprising extruding a composition comprising
   (a) at least one vinylidene chloride polymer/methyl acrylate interpolymer having at most about 6 weight percent methyl acrylate mer units in the polymer; and
   (b) at least about three weight percent total plasticizer, of which about 0.5 weight percent based on total composition weight is an epoxy plasticizer or combination thereof through a die such that monofilament is formed.
3. A composition comprising:
   (a) at least one epoxy plasticizer;
   (b) at least one methacrylic polymer; and at least one of
   (c) at least one UV stabilizer; or
   (d) at least one ester plasticizer.
4. The composition of embodiment 3 having components (a), (b), (c), (d) or a combination thereof in proportions suitable to result in relative amounts of the components in a vinylidene chloride polymer composition as designated in any other embodiment or combination of embodiments.

5. The composition of embodiment 3 wherein any of (a), (b), (c), (d) or a combination thereof have identities, properties or characteristics designated in any other embodiment.
6. The composition of embodiment 3 which corresponds to any aspect of embodiment 4 and of any aspect of embodiment 5.
7. The monofilament or process of any other embodiment comprising as part of the total plasticizer at least one ester plasticizer in an amount of at least about 0.5 weight percent based on total monofilament weight.
8. The monofilament or process of any other embodiment additionally comprising (c) at least one UV light stabilizer in an amount of at least about 0.25 weight percent based on weight of the monofilament.
9. The monofilament or process of any other embodiment additionally comprising (d) at least one methacrylic polymer formed from a monomer mixture or having mer units originating from a monomer composition consisting essentially of alkyl methacrylate ester monomers, alkyl acrylate ester monomers, styrenic monomers or a combination thereof in an amount sufficient to achieve more uniform feeding through an extruder than is achieved in its substantial absence, preferably in an amount of at least about 0.2 percent based on weight of the monofilament.
10. The monofilament or process of any other embodiment wherein the total amount of plasticizer is at most about 10 weight percent of the composition.
11. The monofilament or process of any other embodiment wherein the vinylidene chloride interpolymer is formed from a monomer mixture comprising vinylidene chloride monomer in an amount of at most about any of 97, 96.5, 96 or 95 or at least about any of 94 or 95 weight percent of the monomers in the vinylidene chloride polymer.
12. The monofilament or process of any other embodiment wherein the vinylidene chloride interpolymer is formed from a monomer mixture comprising methyl acrylate is in an amount of at least about any of 3, 3.5, 4, or 5 weight percent, and independently at most about any of 6 or 5 weight percent based on total vinylidene chloride interpolymer.
13. The monofilament or process of any other embodiment wherein the vinylidene chloride polymer has a molecular weight sufficient to form a fiber having the desired tensile strength, preferably at least about any of 50,000; 65,000; or 80,000 and independently preferably at most about any of 200,000; 150,000; or 100,000 Daltons.
14. The monofilament or process of any other embodiment wherein the epoxy plasticizer comprises at least one epoxidized oil, preferably epoxidized soybean oil or epoxidized linseed oil or a combination thereof.
15. The monofilament or process of any other embodiment wherein the ester plasticizer comprises at least one aliphatic or aromatic ester plasticizers preferably at least one of dibutyl sebacate; acetyl tributyl citrate (ATBC); other polymeric or high molecular weight ester oils, or a combination thereof, more preferably at least one of dibutyl sebacate, ATBC or a combination thereof; independently preferably each such ester, especially each polymeric or high molecular weight ester oil, has a molecular weight of at least about 300.
16. The monofilament or process of any other embodiment wherein the total amount of plasticizers is preferably at least about any of 3, 5, or 6 percent plasticizer, and independently preferably at most about any of 10, 9, or 8 percent plasticizer based on total weight of the polyvinylidene chloride composition.
17. The monofilament or process of any other embodiment wherein of the amount of total plasticizer, at least about any of 0.5, 1, or 2 and independently preferably at most about any of 10, 9, or 8 percent based on total weight of the polyvinylidene chloride composition, is at least one epoxy plasticizer, preferably at least one epoxidized oil plasticizer.
18. The monofilament or process of any other embodiment wherein the composition additionally comprises at least one UV stabilizer.
19. The monofilament or process of any other embodiment wherein the UV stabilizer is at least one of 2-hydroxy-4-methoxybenzophenone, 2-hydroxy-4-noctoxybenzophenone, 2-(2H-benzotrazol-2-yl)-p-cresol, 2-(2'-hydroxy-5'-octylpnenyl)-benzotriazole, 2-(2H-benxotrazol-2-yl)-4,6-ditertpentylphenol, 2-(2'-hydroxy-3',5'-di-t-amylphenyl)benzotriazole or 2-[4,6-bis(2,4-dimethylphenyl)-1,3,5-triazin-2-yl]-5-(octyloxy)phenol or a combination thereof.
20. The monofilament or process of any other embodiment wherein the amount of UV stabilizer is at least about any of 0.25, 0.5, or 1 and independently preferably at most about any of 4, 3, or 2 percent based on total composition including polymer and additives.
21. The monofilament or process of any other embodiment wherein the composition comprises at least one methacrylic polymer in an amount sufficient to achieve more uniform feeding through an extruder than is achieved in its substantial absence.
22. The monofilament or process of any other embodiment wherein the methacrylic polymer comprises mer units from at least one alkyl methacrylate monomer, or a combination thereof, optionally with at least one alkyl acrylate or styrenic monomer or a combination thereof.
23. The monofilament or process of any other embodiment wherein the methacrylic polymer comprises an alkyl methacrylate monomer, preferably methyl methacrylate, more preferably in an amount of at least about any of 30, 40, or 50 weight percent, and at least one additional methacrylic or acrylic alkyl ester or styrenic monomer or combination thereof, more preferably at least one additional methacrylic or acrylic alkyl ester.
24. The monofilament or process of any other embodiment wherein the alkyl groups of the alkyl acrylate and alkyl methacrylate monomers of the methacrylic polymer have at least 1 carbon atom and independently preferably at most about any of 16, 8 or 4 carbon atoms.
25. The monofilament or process of any other embodiment wherein the methacrylic polymer comprises methyl methacrylate.
26. The monofilament or process of any other embodiment wherein the methacrylic polymer comprises at least one of methyl acrylate, ethyl acrylate, butyl acrylate, ethyl methacrylate, butyl methacrylate and combinations thereof.
27. The monofilament or process of any other embodiment wherein the methacrylic polymer comprises at least one of styrene, alpha methyl styrene, para methyl styrene, para tert-butyl styrene and combinations thereof.
28. The monofilament or process of any other embodiment wherein the methacrylic polymer has a molecular weight effective in achieving uniform polymer feeding through an extruder, preferably a molecular weight of at least about any of 100,000, 150,000 or 200,000 and independently preferably at most about any of 4,000,000, 700,000, or 400,000 Daltons.

29. The monofilament or process of any other embodiment wherein the methacrylic polymer has a glass transition temperature in a range effective for achieving uniform polymer feeding through an extruder, preferably at least one glass transition temperature of less than about any of 105° C., or 95° C. and independently preferably at least about 30° C.; most preferably also has a second glass transition temperature, which is most preferably below about 40° C. or 30° C.

30. The monofilament or process of any other embodiment wherein the methacrylic polymer is present in an amount effective to achieve more uniform feeding through an extruder than is achieved in its substantial absence, preferably at least about any of 0.2, 0.25, or 0.5 percent and independently at most about any of 4, 1.99, 1 or 0.99 percent by weight based on weight of the total vinylidene chloride polymer composition including the additives and methacrylic polymer.

31. The monofilament or process of any other embodiment wherein the methacrylic polymer is optionally added and mechanically admixed with the polyvinylidene chloride.

32. The monofilament or process of any other embodiment wherein the methacrylic polymer is coagulated onto the polyvinylidene chloride polymer.

33. The monofilament or process of any other embodiment wherein additives different from the methacrylic polymer are combined with the methacrylic polymer and coagulated onto the vinylidene chloride polymer with the methacrylic polymer.

34. The monofilament or process of any other embodiment wherein the methacrylic polymer processing aid is used and the composition is extruded in an extruder having at least one of (a) fewer than about any of 4, 3 or 2 flights in the feed zone; (b) greater than about any of 6, 7 or 8 flights in the feed zone; (c) a feed section height to diameter ratio less than about any of 0.208, 0.203, or 0.200; or (d) a compression ratio less than about any of 3.7, 3, 5 or 3.3. The methacrylic polymer is increasingly useful where at least 2, preferably at least 3, more preferably at least 4 of these characteristics are found in the extruder.

35. The monofilament or process of any other embodiment wherein the methacrylic polymer processing aid is not used and the composition is extruded in an extruder having at least one of (a) greater than about any of 4, 3 or 2 flights in the feed zone; (b) less than about any of 6, 7 or 8 flights in the feed zone; (c) a feed section height to diameter ratio greater than about any of 0.208, 0.203 or 0.200; or (d) a compression ratio greater than about any of 3.7, 3.5 or 3.3. The methacrylic polymer is increasingly useful where at least 2, preferably at least 3, more preferably at least 4 of these characteristics are found in the extruder.

36. The monofilament or process of any other embodiment wherein in addition to the plasticizer or plasticizers and optionally methacrylic polymer, UV stabilizer or combination thereof, at least one additional additive is used, preferably selected from at least one heat or thermal stabilizer, acid scavengers, pigment, processing aid, lubricant, filler, antioxidant and combinations thereof.

37. The monofilament or process of any other embodiment wherein the composition additionally comprises at least one lubricant, preferably selected from stearic acid; fatty ester, wax ester, glycol ester, fatty alcohol ester; n-stearyl alcohol; N,N'-ethylene bis stearamide; metallic salt of fatty acid, calcium stearate, magnesium stearate; polyolefin wax, paraffinic wax, polyethylene and combinations thereof. The process of any other embodiment additionally comprising a step of extruding the composition through a die having at least one hole having a diameter of at most about any of 120, 100, 50, or 2 mm; and independently at least about any of 0.2, 0.3 or 0.6 mm.

The invention claimed is:

1. A monofilament consisting essentially of:

(a) at least one vinylidene chloride polymer/methyl acrylate interpolymer having at most about 6 weight percent methyl acrylate mer units in the polymer;

(b) at least about three weight percent total plasticizer based on total composition weight, of which about 0.5 weight percent based on total composition weight is (b)(1) an epoxidized oil plasticizer and optionally at least about 0.5 weight percent based on total composition weight is (b)(2) an aliphatic or aromatic ester plasticizer selected from the group consisting of dibutyl sebacate; acetyl tributyl citrate (ATBC); other polymeric or high molecular weight ester oils and combinations thereof;

(c) optionally at least one UV light stabilizer; and (d) optionally at least one methacrylic polymer formed from a monomer mixture consisting essentially of alkyl methacrylate ester monomers, alkyl acrylate ester monomers, styrenic monomers or a combination thereof.

2. The monofilament of claim 1 comprising as part of the total plasticizer at least one ester plasticizer in an amount of at least about 0.5 weight percent based on total monofilament weight.

3. The monofilament of claim 1 additionally comprising (c) at least one UV light stabilizer in an amount of at least about 0.25 weight percent based on weight of the monofilament.

4. The monofilament of claim 1 extruded from an extruder having a feed zone, and the feed zone having at least one of (a) greater than about 4 flights in the feed zone; (b) less than about 6 flights in the feed zone; (c) a feed section height to diameter ratio greater than about 0.208; or (d) a compression ratio greater than about 3.7.

5. The monofilament of claim 1 additionally comprising (d) at least one methacrylic polymer formed from a monomer mixture consisting essentially of alkyl methacrylate ester monomers, alkyl acrylate ester monomers, and styrenic monomers.

6. The monofilament of claim 5 wherein the methacrylic polymer comprises at least about 30 weight percent mer units from at least one alkyl methacrylate monomer.

7. The monofilament of claim 5 wherein the methacrylate polymer comprises methyl methacrylate as an alkyl methacrylate monomer.

8. The monofilament of claim 5 wherein the methacrylic polymer comprises at least about 30 weight percent mer units from alkyl methacrylate monomers.

9. The monofilament of claim 5 extruded from an extruder having at least one of (a) fewer than about 4 flights in the feed zone; (b) greater than about 6 flights in the feed zone; (c) a feed section height to diameter ratio less than about 0.208; or (d) a compression ratio less than about 3.7.

10. The monofilament of claim 5 wherein the methacrylic polymer is present in an amount of at least about 0.2 weight percent based on weight of the monofilament.

11. The monofilament of claim 5 wherein the methacrylic polymer is present in an amount of at most about 4 weight percent based on weight of the monofilament.

12. The monofilament of claim 5 wherein the amount of methacrylic polymer is from about 0.25 to about 1.99 weight percent of the monofilament.

13. The monofilament of claim 5 wherein the methacrylic polymer has a weight average molecular weight of at least about 100,000 and at most about 4,000,000 Daltons.

14. The monofilament of claim 5 wherein the methacrylic polymer has at least one glass transition temperature (Tg) between about 30° C. and about 105° C.

15. The monofilament of claim 14 which additionally has at least one Tg below about 40° C.

16. The monofilament claim 1 wherein the total amount of plasticizer is at most about 10 weight percent of the monofilament.

17. A process for producing a monofilament, the process comprising the step of extruding through a die a composition consisting essentially of:

(a) at least one vinylidene chloride polymer/methyl acrylate interpolymer having at most about 6 weight percent methyl acrylate mer units in the polymer;

(b) at least about three weight percent total plasticizer based on total composition weight, of which about 0.5 weight percent based on total composition weight is (b)(1) an epoxidized oil plasticizer and optionally at least about 0.5 weight percent based on total composition weight is (b)(2) an aliphatic or aromatic ester plasticizer selected from the group consisting of dibutyl sebacate; acetyl tributyl citrate (ATBC); other polymeric or high molecular weight ester oils and combinations thereof;

(c) optionally at least one UV light stabilizer; and (d) optionally at least one methacrylic polymer formed from a monomer mixture consisting essentially of alkyl methacrylate ester monomers, alkyl acrylate ester monomers, styrenic monomers or a combination thereof.

18. The process of claim 17 wherein the die has a diameter of at least about 0.2 mm and at most about 120 mm.

19. The process of claim 17 wherein the composition additionally contains at least one methacrylic polymer and is extruded in a extruder having at least one of (a) fewer than about 4 flights in the feed zone; (b) greater than about 6 flights in the feed zone; (c) a feed section height to diameter ratio less than about 0.208; or (d) a compression ratio less than about 3.7.

20. The process of claim 17 wherein no methacrylic polymer processing aid is added to the composition which is extruded in a extruder having at least one of (a) greater than about 4 flights in the feed zone; (b) fewer than about 6 flights in the feed zone; (c) a feed section height to diameter ratio greater than about 0.208; or (d) a compression ratio greater than about 3.7.

* * * * *